United States Patent [19]

Cole

[11] 4,098,444

[45] Jul. 4, 1978

[54] HYDROJET FOR PROPELLING YARN

[75] Inventor: Paul Morrison Cole, Wilmington, Del.

[73] Assignee: E. I. Du Pont de Nemours and Company, Wilmington, Del.

[21] Appl. No.: 807,737

[22] Filed: Jun. 17, 1977

[51] Int. Cl.[2] ..... B65H 17/32

[52] U.S. Cl. ..... 226/97

[58] Field of Search ..... 226/7, 97, 196

[56] References Cited

U.S. PATENT DOCUMENTS

| | | | |
|---|---|---|---|
| 2,919,970 | 1/1960 | Russell | 226/97 X |
| 3,863,822 | 2/1975 | Keldany | 226/97 X |

*Primary Examiner*—Richard A. Schacher

[57] ABSTRACT

A hydrojet for propelling textile yarn at high speeds to a collector includes a source of high pressure water issuing from an orifice to form a jet stream, which is aligned to contact yarn passing through a slotted engager guide located directly above a tube through which the yarn is propelled by the jet stream. The angle of the jet stream with respect to the axis of the tube is about 6°.

2 Claims, 3 Drawing Figures

HYDROJET FOR PROPELLING YARN

BACKGROUND OF THE INVENTION

This invention relates to an apparatus for forwarding textile fibers in the form of continuous filaments. More particularly, the invention is concerned with propelling the yarn at high speeds with a stream of water.

It is common in the textile industry to produce continuous filament yarns at speeds somewhat in excess of 3000 m/min and operation at higher speeds, i.e., 6000 m/min and above would be attractive economically if stringup were simplified.

It is known to propel yarn at high speeds using water jets such as are employed in jet looms wherein yarn is fed through a hollow needle and is captured by an annular stream of water issuing under pressure around the needle. This type of jet however lacks capability for a running stringup of yarn and when used on a loom the jet can only be threaded while the loom is idle. This is out of the question for the high speed production referred to above where a running stringup is required.

SUMMARY OF THE INVENTION

An apparatus for forwarding yarn comprising an elongated tube having an entrance and an exit through which the yarn passes from a source to a collector; a jet spaced from said entrance for directing a high pressure stream of water into said tube at an angle of from about 6° to about 15° with the central axis of the tube at the entrance of the tube whereby the stream grazes one inside wall of the tube at its entrance and ricochets off the opposite side of the inside wall of the tube at a location along its length and fills the tube at its exit; and a plate having a slot therein open at one end and closed at the other end positioned between the jet and the entrance of the tube, said slot having its closed end aligned with the central axis of the tube, said yarn passing from said source over the closed end of said slot into said tube, said stream passing through said slot and engaging said yarn as the yarn passes over said closed end.

DETAILED DESCRIPTION OF THE PREFERRED EMBODIMENT

Figure 1:
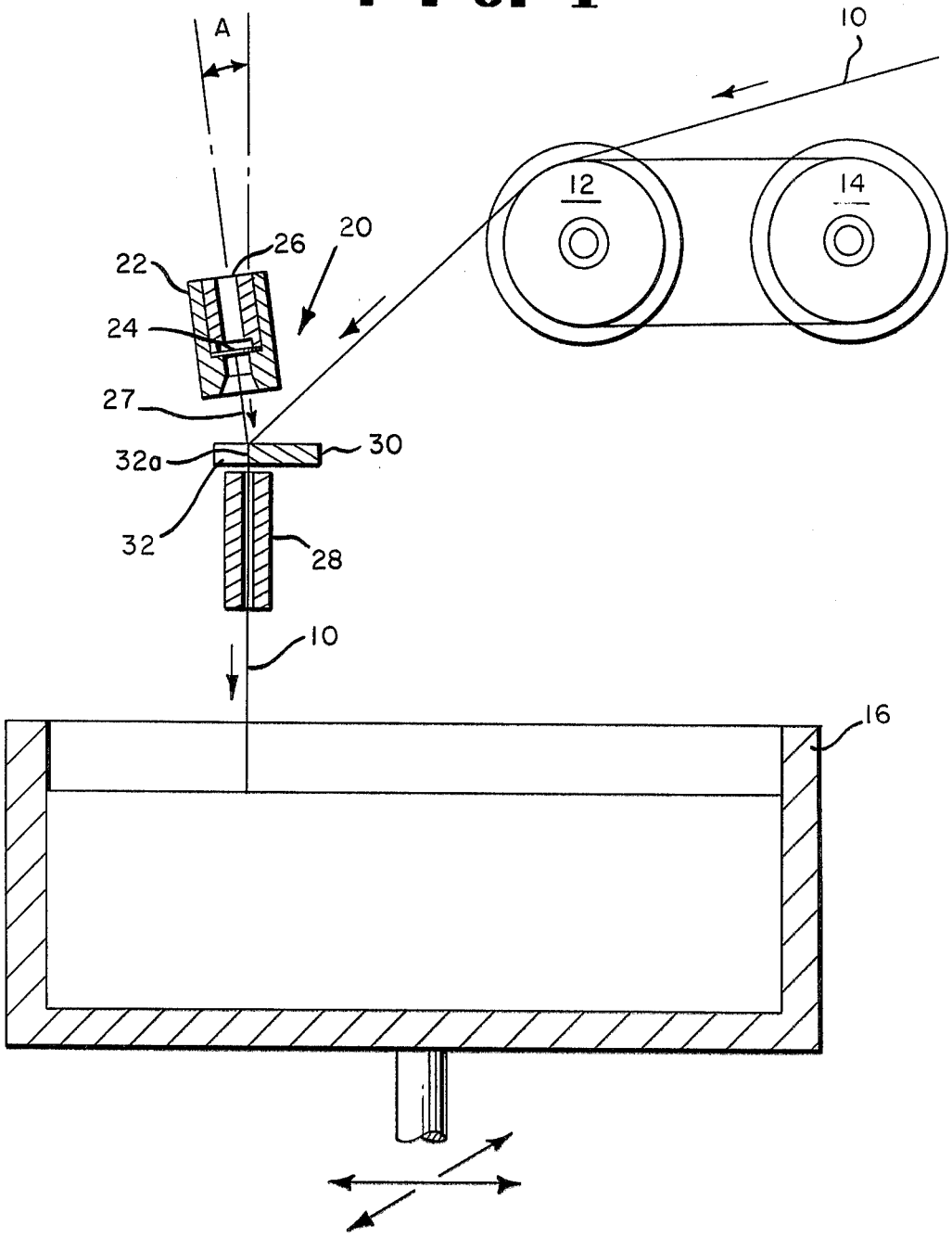
FIG. 1 illustrates in cross section the preferred embodiment of the invention.

Referring to FIG. 1, a continuous filament yarn 10 which may be obtained directly from a spinning machine is passed around rolls 12, 14 through a jet apparatus generally designated 20 into a collector 16 which is traversed in two directions by means not shown to uniformly distribute the yarn 10 in the collector.

The jet apparatus 20 has three major components, a water jet 22, an elongated tube 28 and an engager plate 30 positioned in the space between the jet 22 and the tube 28 and having an open end slot 32 therein. The water jet 22 has a thin orifice plate 24 with pressurized water behind it supplied through inlet passage 26. Typically plate 24 in jet 22 is about 0.010 inch thick and has an orifice centrally through the plate of about 0.010 inch in diameter. The tube 28 operates effectively with the diameters ranging from 0.030 to 0.050 inch in diameter and from ½ inch to 24 inches in length. The engager 30 which serves the important function of bringing the yarn 10 into the path of the jet stream 27 is a plate about 0.040 inch thick with an open slot 32 about 0.020 inch wide by 1/16 inch deep terminating in the closed end **32*a* of the slot. Performance is considerably improved when the jet is aligned with the tube 28 so that the jet stream 27 is angled with the central axis of the tube 28** at an angle A of from about 6° to about 15°.

Figure 2:
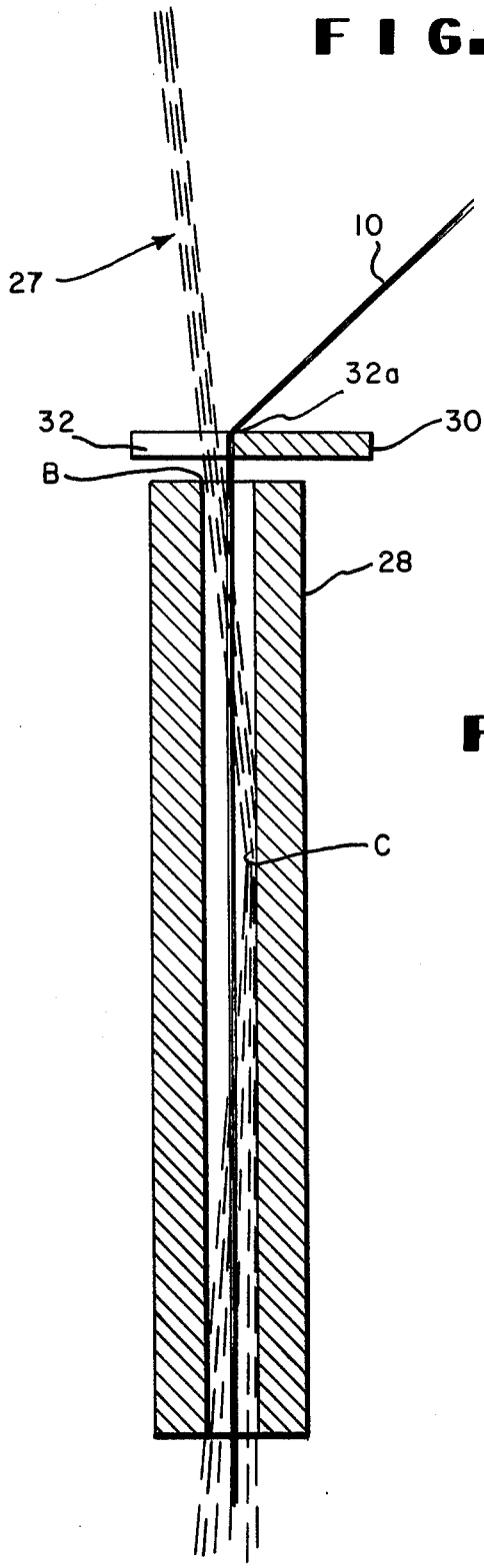
FIG. 2 shows a detail of FIG. 1 in cross section.
Figure 3:
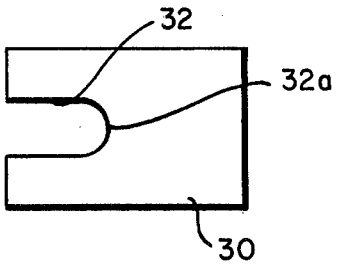
FIG. 3 is a plan view of the engager of FIG. 2.

The operation of the jet is shown more clearly by referring to FIG. 2 wherein it is seen that yarn 10 traveling over the end **32*a* of slot 32 in engager 30 is brought into the path of jet stream 27 which is so angled to just graze the wall of tube 28 at location B at the entrance of the tube and ricochets off the wall of the tube at a location C opposite from B well down inside the tube and fills the tube at its exit. The yarn is propelled into and through tube 28 at high velocities. In test runs using 150 denier yarn, yarn has been propelled at about 6000 yards per minute using a water pressure of about 1700 pounds per square inch in jet 22**.

What is claimed is:

1. An apparatus for forwarding yarn comprising: an elongated tube having an entrance and an exit through which the yarn passes from a source to a collector; a jet spaced from said entrance for directing a high pressure stream of water into said tube at an angle of from about 6° to about 15° with the central axis of the tube at the entrance of the tube whereby the stream grazes one inside wall of the tube at its entrance and ricochets off the opposite side of the inside wall of the tube at a location along its length and fills the tube at its exit; and a plate having a slot therein open at one end and closed at the other end positioned between the jet and the entrance of the tube, said slot having its closed end aligned with the central axis of the tube, said yarn passing from said source over the closed end of said slot into said tube, said stream passing through said slot and engaging said yarn as the yarn passes over said closed end.

2. The apparatus as defined in claim 1, said high pressure stream of water being directed into said tube at an angle of about 6°.

* * * * *